US007455186B2

(12) United States Patent
Gregory

(10) Patent No.: US 7,455,186 B2
(45) **Date of Patent: *Nov. 25, 2008**

(54) TIE RACK

(76) Inventor: David M. Gregory, 7324 Hummingbird Cir., Oklahoma City, OK (US) 73162

( * ) Notice: Subject to any disclaimer, the term of this patent is extended or adjusted under 35 U.S.C. 154(b) by 38 days.

This patent is subject to a terminal disclaimer.

(21) Appl. No.: 11/135,970

(22) Filed: May 24, 2005

(65) Prior Publication Data

US 2006/0266720 A1 Nov. 30, 2006

(51) Int. Cl.
*A47F 7/00* (2006.01)

(52) U.S. Cl. ..... 211/85.3; 211/87.01; 211/99

(58) Field of Classification Search ..... 211/85.2, 211/85.3, 60.1, 61, 105.1, 123, 13.1, 85.9, 211/44, 87.01, 96, 169, 99–102, 171
See application file for complete search history.

(56) References Cited

U.S. PATENT DOCUMENTS 2,128,606 A * 8/1938 Voss, Jr. ..... 211/85.3
2,267,014 A * 12/1941 Case ..... 211/123
2,398,858 A * 4/1946 Rosenblatt ..... 211/96
2,525,259 A * 10/1950 Fenzl ..... 211/85.3
2,603,359 A * 7/1952 Pestyner ..... 211/85.3
2,658,626 A * 11/1953 Arseneault ..... 211/85.3
2,724,510 A * 11/1955 Williams ..... 211/104
D190,552 S * 6/1961 Doucet ..... D6/548
3,853,225 A * 12/1974 Gegauff ..... 211/85.3
4,109,794 A * 8/1978 Samuel et al. ..... 211/85.3
5,149,003 A 9/1992 Tharp
5,373,950 A 12/1994 Marc
5,425,463 A 6/1995 Toscanini et al.
D422,795 S 4/2000 Hollinger
6,390,308 B1 * 5/2002 Ebrahim ..... 211/85.3

* cited by examiner

*Primary Examiner*—Jennifer E. Novosad
(74) *Attorney, Agent, or Firm*—Dunlap Codding, P.C.

(57) ABSTRACT

A tie rack is provided that includes a mounting plate, a first side arm extending from the mounting plate, second side arm in a spaced apart, parallel relationship to the first side arm. A first mounting rod extends from the first side arm toward the second side arm, and a second mounting rod extends from the second side arm toward the first side arm. The second mounting rod has a distal end in a spaced apart relationship with the distal end of the first mounting rod. A drag rod extends between the first side arm and the second side arm in a spaced apart and parallel relationship to the first mounting rod and the second mounting rod such that when a tie is looped over one of mounting rods with two portions of the tie extending therefrom, the two portions are extendable over one side of the drag rod.

2 Claims, 2 Drawing Sheets

TIE RACK

BACKGROUND OF THE INVENTION

1. Field of the Invention

This invention relates generally to racks, and more particularly, but not by way of limitation, to an improved rack for holding ties, scarfs, and the like.

2. Brief Description of Related Art

Various kinds of tie racks are known in the art, including a type having a plurality of pivotable arms which are located adjacent one another on a support and which, when access is desired to the ties, are pivoted to a position in which they extend at right angles to the support. The support is intended to be mounted on a wall or door of a clothes closet, or in a similar position. Each of the arms has a length that is just sufficient to support a single tie, and the arms are spaced from one another in direction transversely of their pivot axis by a distance which is slightly longer than the length of the arms so that, when the arms are pivoted back against the support to a storage position, all the arms will become located in a common plane with the free end of one arm being located adjacent the pivoted end of the next arm, and so on. An arrangement is provided which is coupled with all of the arms in order to pivot all of the arms simultaneously to the storage position or to the access position.

Other types of racks have arms that are fixed to a support frame or to a carousel mechanism that allows the arms to be selectively rotated until the desired tie is located. Like the pivoting arms described above, each of the fixed arms has a length that is just sufficient to support a single tie.

Because of the limited size of the arms of many tie racks and the close proximity of one arm to an adjacent arm, the act of removing a selected tie from an arm and placing the tie back on the arm is a tedious endeavor that often results in adjacent ties being knocked off their respective arms.

To this end, a need exists for an improved tie rack that is capable of supporting multiple ties while allowing a selected tie to be easily removed and replaced without disrupting the other ties supported on the rack. It is to such an improved tie rack that the present invention is directed.

DETAILED DESCRIPTION OF THE INVENTION

Figure 1:
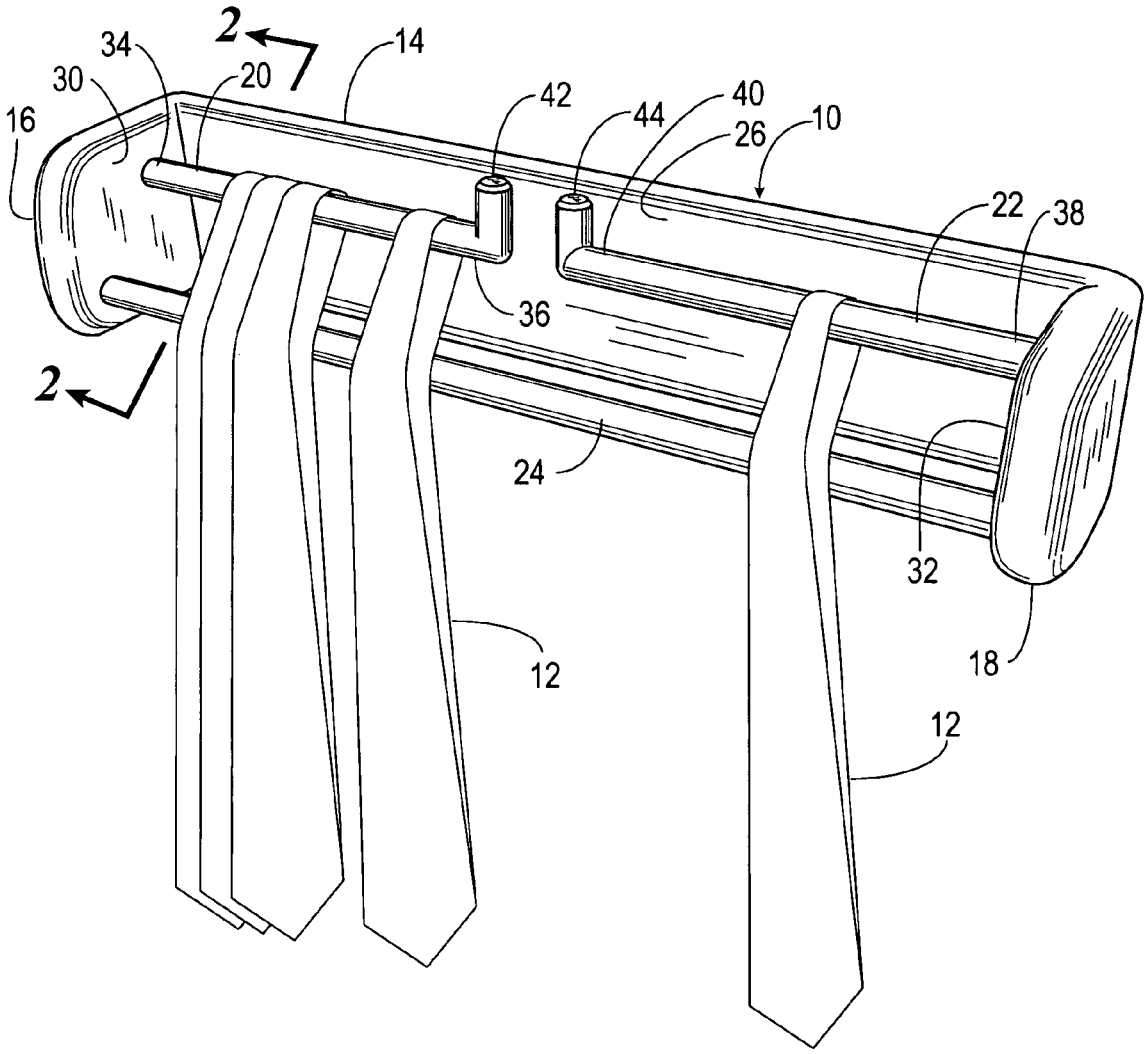
FIG. 1 is a perspective view of a tie rack constructed in accordance with the present invention shown supporting a plurality of ties.

Referring now to the drawings, a tie rack 10 constructed in accordance with the present invention is shown supporting a plurality of neck ties 12. Broadly, the tie rack 10 includes a mounting plate 14, a first side arm 16, a second side arm 18, a first mounting rod 20, a second mounting rod 22, and a drag rod 24.

Figure 2:
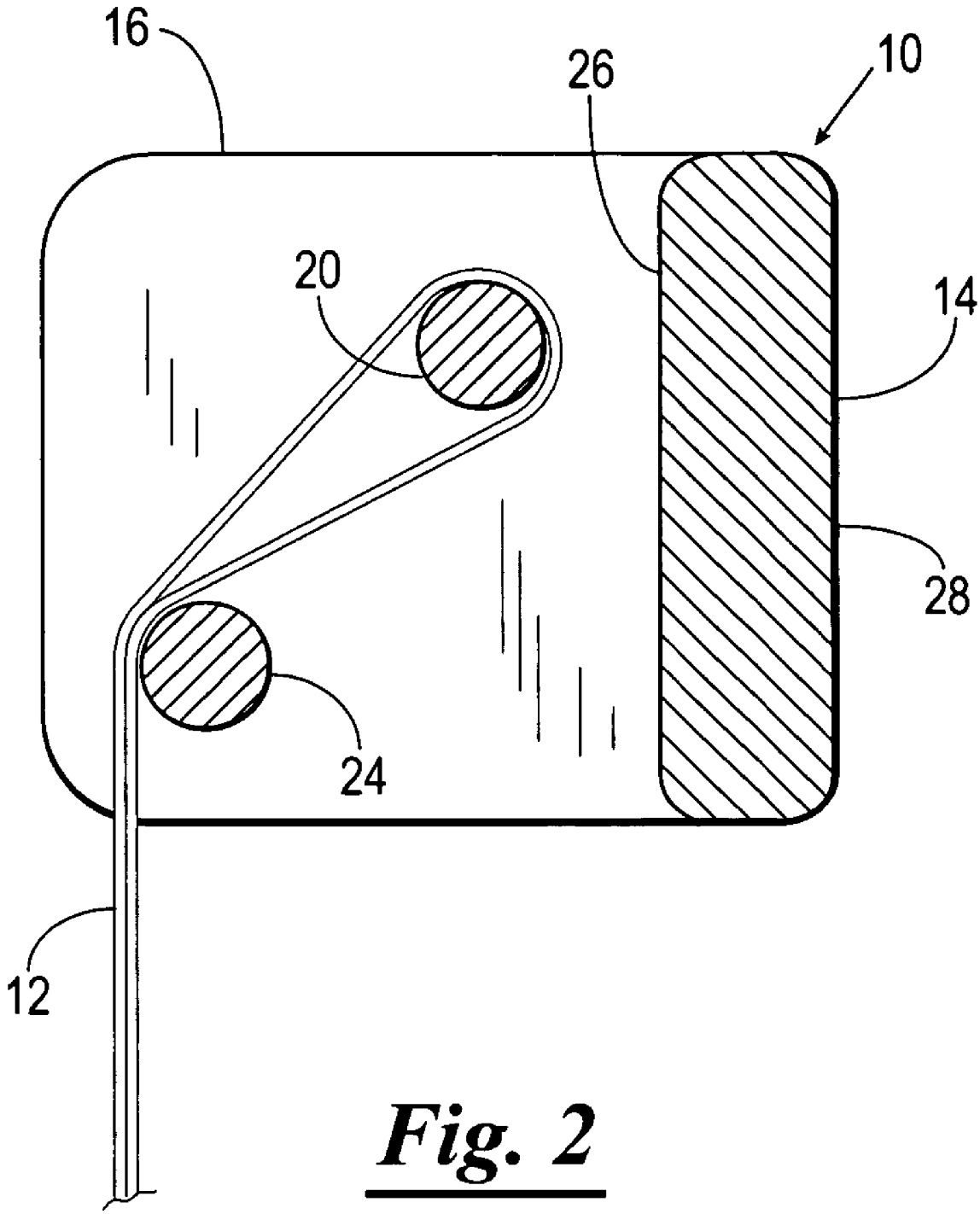
FIG. 2 is a sectional view taken along line 2-2 of FIG. 1.

The mounting plate 14 is a planar member having a front surface 26 and a back surface 28 (FIG. 2). The mounting plate 14 is mountable to a support surface, such as a door or a wall with suitable fasteners.

The first side arm 16 and the second side arm 18 extend perpendicularly from the front surface 26 of the mounting plate 14 in a spaced apart, parallel relationship to each other. It will be appreciated that the first side arm 16 and the second side arm 18 may be mounted directly to a support surface, such as a wall or door, thereby eliminating the need for the mounting plate 14. The first side arm 16 has a inner facing surface 30, and the second side arm 18 has an inner facing surface 32.

The first mounting rod 20 has a proximal end 34 and a distal end 36. Similarly, the second mounting rod 22 has a proximal end 38 and a distal end 40. The proximal end 34 of the first mounting rod 20 is connected to the first side arm 16 so that the first mounting rod 16 extends from the inner facing surface 30 of the first side arm 16 toward the second side arm 18. Likewise, the proximal end 38 of the second mounting rod 22 is connected to the second side arm 18 so that the second mounting rod 22 extends from the inner facing surface 32 of the second side arm 18 toward the first side arm 16. In a preferred embodiment, the second mounting rod 18 is positioned in axial alignment with the first mounting rod 20, and the distal end 40 of the second mounting 22 is in a spaced relationship with respect to the distal end 36 of the first mounting rod 20. The distal end 36 of the first mounting rod 20 is provided with a catch member 42, and the distal end 40 of the second mounting rod 22 is provided with a catch member 44. The distal end 40 of the second mounting rod 22 is preferably spaced from the distal end 36 of the first mounting rod 20 a distance of at least approximately 1.5 inches to facilitate the positioning of a tie on one of the first mounting rod 20 and the second mounting rod 22. It should be understood that the tie rack 10 may be constructed to have only one mounting rod instead of two as described above.

The drag rod 24 is connected to the first side arm 16 and the second side arm 18 such that the drag rod 24 extends therebetween. The drag rod 24 is positioned in a spaced apart and parallel relationship to the first mounting rod 20 and the second mounting rod 22 such that when a tie, such as tie 12*a*, is looped over one of the mounting rods 20, 22 with two portions 46*a* and 46*b* of the tie 12*a* extending from the mounting bar 20 or 22, the two portions 46 and 48 are extendable over one side of the drag bar 24. Preferably, the drag bar 24 is vertically offset from the first mounting rod 20 and the second mounting rod 22, and the drag rod 24 is positioned below and forward of the first mounting rod 20 and the second mounting rod 22.

In the preferred embodiment, the first mounting rod 20 and the second mounting rod 22 are cylindrically shaped and have a diameter of about 0.75 inches or greater. Similarly, the drag rod 24 is cylindrical in shape and has a diameter of about 0.75 inches or greater. The drag rod 24 is vertically spaced from the first mounting rod 20 and the second mounting rod 22 a distance of approximately 1.5 inches and horizontally spaced a distance of about 2 inches.

The components of the tie rack 10 may be fabricated of any suitable material, such as wood, plastic, or metal. However, as will become apparent below, the drag rod 24 should have an outer surface such that the coefficient of friction between the ties 12 and the outer surface of the drag rod 24 is greater than the coefficient of friction between the overlapping ties 12. To this end, the outer surface of the drag rod 24 is provided with a texture, such as by roughing the outer surface of the drag rod 24 should it be fabricated of wood, or lining the drag rod 24 with a material having a higher coefficient of friction than the ties 12, such as wool, cotton, or the like.

In use, the ties 12 are looped over the mounting rods 20, 22 such that the portions 46 and 48 of the ties 12 extend from the mounting rods 20, 22. The portions 46 and 48 of the ties 12 are extended over one side of the drag rod 24. As such, at least one of the portions 46, 48 of the ties 12 extend in a serpentine pattern. The ties 12 may be positioned on the first and second mounting rods 20, 22 in a random fashion without the need to meticulously place each tie 12 in a particular location. As such, the placing of the ties 12 on the tie rack 10 is easily accomplished.

In removing a tie 12 from the tie rack 10, a desired tie 12 is first selected. One portion 46,48 of the selected tie 12 is then grasped and simply pulled off the drag rod 24 and the mounting rod 20 or 22. Because of the friction between the drag rod 24, and the non-selected ties 12, the selected tie 12 is removed from the tie rack 10 without causing the non-selected ties 12 positioned on the mounting rod 20, 22 to be pulled along with the selected tie 12.

While the tie rack 10 has been described for use in supporting neck ties, it will be appreciated that the tie rack 10 of the present invention is not limited to such use and may be used to support other objects, such as scarfs and handkerchiefs. Also, it will be appreciated that the tie rack 10 may be made in any length depending on the number of ties one has and amount of wall space available.

From the above description, it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A tie rack in combination with a plurality of ties, the tie rack comprising:

a first side arm mounted to a support surface;

a second side arm mounted to the support surface in a spaced-apart, parallel relationship to the first side arm;

a mounting rod extending from the first side arm toward the second side arm, the first mounting rod having a distal end spaced from the second side arm; and a drag rod extending between the first side arm and the second side arm in a vertically and horizontally offset, parallel relationship to the mounting rod with the drag rod positioned below and forward of the mounting rod, and in a fixed, spaced-apart, and substantially parallel relationship to the support surface, the drag rod having an outer surface, wherein the ties are looped over the mounting rod with the ties overlapping one another and each tie having two portions extending from the mounting rod and extending over a forward side of the drag rod so that each of the two portions of the ties is supported by the drag rod, and wherein the coefficient of friction between the ties and the outer surface of the drag rod is greater than the coefficient of friction between overlapping ties such that upon selecting one of the ties for removal from the mounting rod and pulling one of the portions of the selected tie so as to drag the selected tie over the mounting rod and the drag rod, the selected tie slides over the non-selected ties thereby leaving the non-selected ties extending from the mounting rod.

2. The tie rack of claim 1 wherein the distal end of the mounting rod is provided with a catch member.

* * * * *